US005703027A

United States Patent [19]

Caravajal et al.

[11] Patent Number: 5,703,027

[45] Date of Patent: Dec. 30, 1997

[54] MONOMERIC RICH SILICATE SYSTEM IN AUTOMATIC DISHWASHING COMPOSITION WITH IMPROVED GLASS ETCHING

[75] Inventors: Gregory Stephen Caravajal, Fairfield; Janet Layne Marshall, Cincinnati, both of Ohio

[73] Assignee: The Procter & Gamble Company, Cincinnati, Ohio

[21] Appl. No.: 346,560

[22] Filed: Nov. 29, 1994

[51] Int. Cl.[6] ..... C11D 3/08; C11D 3/06; C11D 3/10; C11D 3/60

[52] U.S. Cl. ..... 510/232; 510/221; 510/226; 510/228; 510/229; 510/230; 510/233; 510/374; 510/375; 510/378; 510/511

[58] Field of Search ..... 252/135, 174.14, 252/174.19, 156, 99, 94, 174.21, 525, 174.24, DIG. 10, DIG. 11; 510/220, 221, 223, 224, 226, 228–233, 511, 374, 375, 378

[56] References Cited

U.S. PATENT DOCUMENTS

| | | | |
|---|---|---|---|
| 3,128,250 | 4/1964 | Lintner et al. | 252/99 |
| 3,255,117 | 6/1966 | Knapp et al. | 252/99 |
| 3,350,318 | 10/1967 | Green | 252/135 |
| 3,410,804 | 11/1968 | Walsh | 252/99 |
| 3,494,868 | 2/1970 | Gray | 252/99 |
| 3,640,878 | 2/1972 | Chirash et al. | 252/99 |
| 3,708,427 | 1/1973 | Jakobi et al. | 252/99 |
| 3,755,180 | 8/1973 | Austin | 252/99 |
| 3,763,047 | 10/1973 | Fairs | 252/99 |
| 3,852,209 | 12/1974 | Hofmann | 252/95 |
| 3,966,627 | 6/1976 | Gray | 252/99 |
| 4,001,132 | 1/1977 | Maguire, Jr. | 252/105 |
| 4,028,282 | 6/1977 | Okumura et al. | 252/537 |
| 4,083,795 | 4/1978 | Joubert | 252/99 |
| 4,102,799 | 7/1978 | Finck | 252/99 |
| 4,123,375 | 10/1978 | Altenschopfer et al. | 252/99 |
| 4,127,496 | 11/1978 | Stokes | 252/102 |
| 4,147,650 | 4/1979 | Sabatelli et al. | 252/99 |
| 4,244,832 | 1/1981 | Kaneko | 252/99 |
| 4,349,347 | 9/1982 | Masri et al. | 8/139 |
| 4,457,322 | 7/1984 | Rubin et al. | 134/2 |
| 4,528,039 | 7/1985 | Rubin et al. | 134/2 |
| 4,801,396 | 1/1989 | Altenschöpfer et al. | 252/99 |
| 4,861,503 | 8/1989 | Hollingsworth et al. | 252/135 |
| 4,931,203 | 6/1990 | Ahmed et al. | 252/99 |
| 4,937,011 | 6/1990 | Schmid et al. | 252/99 |
| 5,089,162 | 2/1992 | Rapisarda et al. | 510/101 |
| 5,232,622 | 8/1993 | Jones et al. . | |

FOREIGN PATENT DOCUMENTS

| | | |
|---|---|---|
| 0 101 099 A1 | 6/1983 | European Pat. Off. . |
| 0323659 | 7/1989 | European Pat. Off. . |
| 0479370 | 4/1992 | European Pat. Off. . |
| A-516555 | 5/1992 | European Pat. Off. . |
| A-516554 | 5/1992 | European Pat. Off. . |
| 41 28 672 | 8/1991 | Germany . |
| 1384244 | 2/1975 | United Kingdom . |
| WO 93/25729 | 12/1993 | WIPO . |

OTHER PUBLICATIONS

Chemical Abstracts Registry File listing for RN# 1344–09–8, 1995 (no mo. available).

U.S. application No. 08/147,219, Sadlowski, filed Nov. 3, 1993.

U.S. application No. 08/147,222, You et al., filed Nov. 3, 1993.

U.S. application No. 08/147,224, Sadlowski, filed Nov. 3, 1993.

U.S. application No. 08/172,627, Sadlowski, filed Dec. 23, 1993.

U.S. application No. 08/344,400, Sadlowski, filed Nov. 24, 1994.

Silicon Compounds (Syn inorganic silicates), Encyclopedia of Chemical Technology 1982, vol. 20, pp. 855–880.

*Primary Examiner*—Ardith Hertzog

*Attorney, Agent, or Firm*—Michael D. Jones; George W. Allen; Mary Pat McMahon

[57] ABSTRACT

Automatic dishwashing detergent compositions comprising a certain combination of metasilicate with other silicate (polymeric) components are disclosed. Particularly preferred compositions also comprise low foaming surfactant and detergency builders.

14 Claims, No Drawings

MONOMERIC RICH SILICATE SYSTEM IN AUTOMATIC DISHWASHING COMPOSITION WITH IMPROVED GLASS ETCHING

TECHNICAL FIELD

The present invention is in the field of automatic dishwashing detergents. More specifically, the invention relates to automatic dishwashing detergents which provide enhanced glass care benefits. The automatic dishwashing compositions comprise a balance of monomeric (metasilicate) silicate with other silicate components.

BACKGROUND OF THE INVENTION

Automatic dishwashing detergents (hereinafter ADDs) used for washing tableware in the home or institutionally in machines especially designed for the purpose have long been known. Dishwashing in the seventies is reviewed by Mizuno in Vol. 5, Part III of the Surfactant Science Series, Ed. W. G. Cutler and R. C. Davis, Marcel Dekker, N.Y., 1973, incorporated by reference. The particular requirements of cleansing tableware (this includes silverware, glassware, china, plastic, pots and pans and the like) and leaving it in a sanitary, essentially spotless, residue-free state has indeed resulted in so many particular ADD compositions that the body of art pertaining thereto is now recognized as quite distinct from other cleansing product arts.

In light of legislation and current environmental trends, modern ADD products desirably contain low levels or are substantially free of inorganic phosphate builder salts and/or are concentrated formulations (i.e. ½ cup vs. full cup usage). Unfortunately, nonphosphated ADD products in technical terms may sacrifice efficacy, especially owing to the deletion of phosphate and, in some instances, chlorine mainstay cleansing ingredients. Concentrated or compact compositions similarly exhibit formulation problems.

Users of ADDs have come to expect tableware will be rendered essentially spotless and film-free in addition to cleaning. In practice, this means avoiding film-forming components. The formulator must employ ingredients which are sufficiently soluble that residues or build-up do not occur. Again, while some ingredients may be adequate on grounds of cleaning, spotting and filming, solubility considerations may diminish their usefulness. Solubility considerations are even more acute with the newer "low usage", "concentrated", ADD compositions whose overall solubility can be less than that of conventional ("full cup") products.

It has generally been believed by the formulator of ADDs that inexpensive cleaning can be achieved via high alkalinity and/or high silicate levels (for example as provided by formulations comprising high percentages by weight of sodium hydroxide or metasilicate). It has been discovered that the ratio of the silicate employed can affect cleaning and/or glass etching. While it has been discovered that metasilicate does not contribute to glass etching, severe penalties result in these compositions in terms of cleaning, product corrosiveness to dishwashers and tableware, especially china and glassware and incompatibility with other detergent ingredients. It is therefore highly desirable to achieve good end-results without yielding the undesirable problems generally associated with the use of high alkalinity/high metasilicate.

It has now been unexpectedly discovered that automatic dishwashing detergents especially granular or powder form, other silicate, especially can provide the desired glasscare benefits by formulating selected metasilicate and disilicate, compounds into ADDs having particularly defined ratios and pH ranges. The composition when dissolved at from about 2000 to about 5000 ppm (parts per million), preferably from about 2500 to about 4500 ppm in an automatic dishwasher affords a pH in the range from about 8 to about 13, more preferably from about 9 to about 12, even more preferably from about 9.5 to about 11.5.

The novel ADDs have the property of removing stains objected to by the consumer from dishware, even in a nil or low phosphate containing ADD. The compositions have the cleaning and spotlessness advantages such as enhanced glass care (i.e. reduction of cloudiness and iridescence negatives) and reduction of silicate/carbonate deposition filming negatives. ADD embodiments including bleach, especially oxygen generated, and enzyme-containing compositions are provided for powerful cleaning of wide-ranging soils while retaining the advantages of a generally noncorrosive product matrix.

SUMMARY OF THE INVENTION

The present invention encompasses automatic dishwashing detergent compositions, especially granular or powder-form automatic dishwashing detergent compositions, comprising by weight (a) from about 0.01% to about 15%, preferably 1% to about 10%, more preferably from about 3% to about 9%, of $SiO_2$ as monomeric silicate (b) from about 1% to about 10%, preferably from about 3% to about 6%, of $SiO_2$ as a second silicate component having a $SiO_2$:$M_2O$ weight ratio (where M=alkali metal) of greater than 1 preferably from about 1.8 to about 3.3, more preferably from about 2 to about 2.5, wherein said monomeric silicate of (a) and silicate of (b) have a $SiO_2$ weight ratio of from about 10:1 to about 1:10; preferably from about 3:1 to about 1:2;

(c) from about 0.01% to about 15%, preferably from about 1% to about 10%, more preferably from about 0.1% to about 8%, of low foaming surfactant; and (d) from about 0.1% to about 50%, preferably from about 5% to about 30%, of detergency builder;

wherein said composition provides a wash solution pH from about 8 to about 13, preferably from about 9 to about 12.

While monomeric silicate, other silicates, low foaming nonionic surfactant and detergency builder are the essential ingredients to the present invention, there are also provided embodiments wherein additional components, especially bleaching agent, enzymes and/or organic dispersants are desirably present. Additional components include but are not limited to suds suppressors, detergent co-surfactants and mixtures thereof.

The present invention also encompasses a method for cleaning soiled tableware comprising contacting said tableware with an aqueous medium having a pH in the range from about 8 to about 13, more preferably from about 9 to about 12, and comprising low foaming nonionic surfactant, detergency builder and a weight ratio of metasilicate to silicate of from about 3:1 to about 1:2. The essential nonionic surfactant, detergency builder, monomeric silicate and silicate are preferably added in a solid form (i.e. powder, granular, tablet) to an automatic dishwashing machine.

DETAILED DESCRIPTION OF THE INVENTION

An automatic dishwashing detergent composition comprising by weight:

(a) from about 0.01% to about 15% of $SiO_2$ as monomeric silicate;

(b) from about 1% to about 10%, of $SiO_2$ as a second silicate component having a $SiO_2$:$M_2O$ weight ratio of greater than 1, wherein said monomeric silicate of (a) and silicate component of (b) have a $SiO_2$ weight ratio of from about 10:1 to about 1:10, preferably from about 3:1 to about 1:2;

(c) from about 0.01% to about 15%, of low foaming surfactant; and (d) from about 0.1% to about 50%, of detergency builder; wherein said composition provides a wash solution pH from about 8 to about 13.

A particularly preferred embodiment is phosphate free and further comprises by weight of the composition from about 0.5% to about 12% total $SiO_2$, active detersive enzyme and from about 0.01% to 8% (as % AVO or % Cl) bleaching agent.

The term wash solution is defined herein to mean an aqueous solution of the product dissolved at 2,000–6,000 ppm, preferably at 2,500–4,500 ppm, in an automatic dishwasher.

The terms monomeric silicate and metasilicate as used herein are interchangeable. Either meaning a silicate with a $SiO_2$:$M_2O$ ratio of about 1.

Silicates

The compositions of the type described herein comprise alkali metal silicates. The alkali metal silicates hereinafter described provide pH adjusting capability, protection against corrosion of metals and against attack on dishware, including fine china and glassware benefits. For glass care and chinaware benefits, i.e., inhibition of corrosion to glasswares and chinawares (etching), the composition should contain a mix (balance) of monomeric silicate and other silicate.

The second silicate component comprises silicates with a ratio of $SiO_2$ to the alkali metal oxide ($M_2O$, where M=alkali metal) of greater than about 1, preferably from about 1.5 to about 3.2, more preferably from about 1.8 to about 3, most preferably from about 2.0 to about 2.4. Preferably, the alkali metal silicate is hydrous, having from about 15% to about 25% water, more preferably, from about 17% to about 20%.

Sodium and potassium, and especially sodium, silicates are preferred. A particularly preferred alkali metal second silicate component is a granular hydrous sodium silicate having a $SiO_2$:$Na_2O$ ratio of from 2.0 to 2.4 available from PQ Corporation, named Britesil H20 and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Under the conditions of the present invention the total $SiO_2$ level is preferably from about 0.5% to about 25%, preferably from about 1% to about 15%, more preferably from about 5% to about 12%, based on the weight of the ADD.

The $SiO_2$ weight ratio of the monomeric silicate to the second silicate component should be between about 10:1 and about 1:1, preferably between about 5:1 and about 1:5, preferably between about 3:1 and about 1:2.

Low-Foaming Nonionic Surfactant

ADD compositions of the present invention comprise low foaming nonionic surfactants (LFNIs). LFNI can be present in amounts from 0 to about 10% by weight, preferably from about 0.25% to about 4%. LFNIs are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 95° F. (35° C.), more preferably solid at about 77° F. (25° C.). For ease of manufacture, a preferred LFNI has a melting point between about 77° F. (25° C.) and about 140° F. (60° C.), more preferably between about 80° F. (26.6° C.) and 110° F. (43.3° C.).

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available SLF18 from Olin Corp. and any biodegradable LFNI having the melting point properties discussed hereinabove.

Anionic Co-surfactant

The automatic dishwashing detergent compositions herein can additionally contain an anionic co-surfactant. When present, the anionic co-surfactant is typically in an amount from 0 to about 10%, preferably from about 0.1% to about 8%, more preferably from about 0.5% to about 5%, by weight of the ADD composition.

Suitable anionic co-surfactants include branched or linear alkyl sulfates and sulfonates. These may contain from about 8 to about 20 carbon atoms. Other anionic cosurfactants include the alkyl benzene sulfonates containing from about 6 to about 13 carbon atoms in the alkyl group, and mono- and/or dialkyl phenyl oxide mono- and/or di-sulfonates wherein the alkyl groups contain from about 6 to about 16 carbon atoms. All of these anionic co-surfactants are used as stable salts, preferably sodium and/or potassium.

Preferred anionic co-surfactants include sulfobetaines, betaines, alkyl(polyethoxy)sulfates (AES) and alkyl (polyethoxy)carboxylates which are usually high sudsing. Optional anionic co-surfactants are further illustrated in published British Patent Application No. 2,116,199A; U.S. Pat. No. 4,005,027, Hartman; U.S. Pat. No. 4,116,851, Kupe et al; and U.S. Pat. No. 4,116,849, Leikhim, all of which are incorporated herein by reference.

Preferred alkyl(polyethoxy)sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$ alcohol itself is preferable commercially available. $C_{12}$–$C_{15}$ alkyl sulfate which has been ethoxylated with from about 1 to about 5 moles of ethylene oxide per molecule is preferred. Where the compositions of the invention are formulated to have a pH of between 6.5 to 9.3, preferably between 8.0 to 9, wherein the pH is defined herein to be the pH of a 1% solution of the composition measured at 20° C., surprisingly robust soil removal, particularly proteolytic soil removal, is obtained when $C_{10}$–$C_{18}$ alkyl ethoxysulfate surfactant, with an average degree of ethoxylation of from 0.5 to 5 is incorporated into the composition in combination with a proteolytic enzyme, such as neutral or alkaline proteases at a level of active enzyme of from 0.005% to 2%. Preferred alkyl (polyethoxy)sulfate surfactants for inclusion in the present invention are the $C_{12}$–$C_{15}$ alkyl ethoxysulfate surfactants with an average degree of ethoxylation of from 1 to 5, preferably 2 to 4, 15 most preferably 3.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Alkyl(polyethoxy)carboxylates suitable for use herein include those with the formula $RO(CH_2CH_2O)x\ CH_2COO—M^+$ wherein R is a $C_6$ to $C_{18}$ alkyl group, x ranges from O to 10, and the ethoxylate distribution is such that, on a weight basis, the amount of material where x is 0 is less than about 20%, preferably less than about 15%, most preferably less than about 10%, and the amount of material where x is greater than 7, is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation, preferably chosen from alkali metal, alkaline earth metal, ammonium, mono-, di-, and tri-ethanol-ammonium, most preferably from sodium, potassium, ammonium and mixtures thereof with magnesium ions. The preferred alkyl(polyethoxy) carboxylates are those where R is a $C_{12}$ to $C_{18}$ alkyl group.

Highly preferred anionic cosurfactants herein are sodium or potassium salt-forms for which the corresponding calcium salt form has a low Kraft temperature, e.g., 30° C. or below, or, even better, 20° C. or lower. Examples of such highly preferred anionic cosurfactants are the alkyl (polyethoxy)sulfates.

The preferred anionic co-surfactants of the invention in combination with the other components of the composition provide excellent cleaning and outstanding performance from the standpoints of residual spotting and filming. However, many of these co-surfactants may also be high sudsing thereby requiring the addition of LFNI, LFNI in combination with alternate suds suppressors as further disclosed hereinafter, or alternate suds suppressors without conventional LFNI components.

Amine Oxide

The ADD compositions of the present invention can optionally comprise amine oxide in accordance with the general formula I:

$$R^1(EO)_x(PO)_y(BO)_zN(O)(CH_2R')_2.qH_2O \quad (I)$$

In general, it can be seen that the structure (I) provides one long-chain moiety $R^1(EO)_x(PO)_y(BO)_z$ and two short chain moieties, $CH_2R'$. R' is preferably selected represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemic, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18 from Ethyl Corp. Preferred long chain amine oxides are disclosed in pending U.S. Ser. No. 08/106,022, filed Aug. 13, 1993, incorporated herein by reference.

pH-Adjusting Control Components/Detergency Builders

The compositions herein may comprise a pH-adjusting component in addition to the silicates herein above, these components are selected from water-soluble alkaline inorganic salts and water-soluble organic or inorganic builders. The pH-adjusting component is selected so that when the ADD is dissolved in water at a concentration of 2000–6000 ppm, the pH remains in the ranges desired. The preferred nonphosphate pH-adjusting component embodiments of the invention is selected from the group consisting of (i) sodium or potassium carbonate or sesquicarbonate
(iii) sodium or potassium titrate
(iii) citric acid
(iv) sodium or potassium bicarbonate
(v) sodium or potassium borate, preferably borax
(vi) sodium or potassium hydroxide; and
(vii) mixtures of (i)–(vi).

Illustrative of highly preferred pH-adjusting component systems are binary mixtures of granular sodium citrate with anhydrous sodium carbonate, and three-component mixtures of granular sodium citrate trihydrate, citric acid monohydrate and anhydrous sodium bicarbonate.

The amount of the pH adjusting component in the instant ADD compositions is generally from about 0.9% to about 99%, preferably from about 1% to about 50%, by weight of the composition. In a preferred embodiment, the pH-adjusting component is present in the ADD composition in an amount from about 5% to about 40%, preferably from about 10% to about 30%, by weight.

For compositions herein having a pH between about 9.5 and about 10.5 (i.e. the initial wash solution) particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other detergency builder salts selected from phosphate and/or nonphosphate detergency builders known in the art.

The detergency builders used to form the base granules can be any of the detergency builders known in the art, which include the various water-soluble, alkali metal, ammonium or substituted ammonium phosphates, polyphosphates, phosphonates, polyphosphonates, carbonates, borates, polyhydroxysulfonates, polyacetates, carboxylates (e.g. titrates), and polycarboxylates. Preferred are the alkali metal, especially sodium, salts of the above and mixtures thereof.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137, 3,400,176 and 3,400,148, incorporated herein by reference.

Non-phosphate detergency builders include but are not limited to the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S- form); nitrilotriacetic acid, tartrate monosuccinic acid, tartrate disuccinic acid, oxydisuccinic acid, carboxymethyloxysuccinic acid, mellitic acid, and sodium benzene polycarboxylate salts.

In general, pH values of the instant compositions can vary during the course of the wash as a result of the water and soil present. The best procedure for determining whether a given composition has the herein-indicated pH values is as follows: prepare an aqueous solution or dispersion of all the ingredients of the composition by mixing them in finely divided form with the required amount of water to have a 3000 ppm total concentration. Do not have any coatings on the particles capable of inhibiting dissolution. (In the case of the second pH adjusting component it should be omitted from the formula when determining the formula's initial pH value). Measure the pH using a conventional glass electrode at ambient temperature, within about 2 minutes of forming the solution or dispersion. To be clear, this procedure relates to pH measurement and is not intended to be construed as limiting of the ADD compositions in any way; for example, it is clearly envisaged that fully-formulated embodiments of the instant ADD compositions may comprise a variety of ingredients applied as coatings to other ingredients, particularly the second pH adjusting component.

Bleaching Agent

Peroxygen Bleach—The ADD compositions of the present invention can contain an amount of oxygen bleach sufficient to provide from 0.01% to about 8%, preferably from about 0.1% to about 5.0%, more preferably from about 0.3% to about 4.0%, most preferably from about 0.8% to about 3% of available oxygen (AvO) or available chlorine by weight of the ADD.

Available oxygen of an ADD or a bleach component is the equivalent bleaching oxygen content thereof expressed as % O. For example, commercially available sodium perborate monohydrate typically has an available oxygen content for bleaching purposes of about 15% (theory predicts a maximum of about 16%). Methods for determining available oxygen of a formula after manufacture share similar chemical principles but depend on whether the oxygen bleach incorporated therein is a simple hydrogen peroxide source such as sodium perborate or percarbonate, is an activated type (e.g., perborate with tetra-acetyl ethylenediamine) or comprises a performed peracid such as monoperphthalic acid. Analysis of peroxygen compounds is well-known in the art: see, for example, the publications of Swern, such as "Organic Peroxides", Vol. I, D. H. Swern, Editor; Wiley, New York, 1970, LC #72-84965, incorporated by reference. See for example the calculation of "percent active oxygen" at page 499. This term is equivalent to the terms "available oxygen" or "percent available oxygen" as used herein.

The peroxygen bleaching systems useful herein are those capable of yielding hydrogen peroxide in an aqueous liquor. These compounds include but are not limited to the alkali metal peroxides, organic peroxide bleaching compounds such as urea peroxide and inorganic persalt bleaching compounds such as the alkali metal perborates, percabonates, perphosphates, and the like. Mixtures of two or more such bleaching compounds can also be used.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred because of environmental issues associated with boron. Many geographies are forcing legislation to eliminate elements such as boron from formulations.

Suitable oxygen-type bleaches are described in U.S. Pat. No. 4,412,934 (Chung et al), issued Nov. 1, 1983, and peroxyacid bleaches described in European Patent Application 033,259. Sagel et al, published Sep. 13, 1989, both incorporated herein by reference, can be used.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include carbonate, sulphate, silicate, borosilicate, fatty carboxylic acids, and mixtures thereof.

For excellent bleaching results the peroxygen bleach component is formulated with an activator (peracid precursor). The activator is present at levels of from about 0.01% to about 15%, preferably from about 1% to about 10%, more preferably from about 1% to about 8%, by weight of the composition. Preferred activators are selected from the group consisting of benzoylcaprolactam (BzCL), 4-nitrobenzoylcaprolactam, 3-chlorobenzoylcaprolactam, benzoyloxybenzenesulphonate (BOBS), nonanoxybenzenesulphonate (NOBS) decooxybenzenesulphonate ($C_{10}$-OBS), benzolyvalerolactam (BZVL) octyloxybenzenesulphonate ($C_8$-OBS), perhydrolyzable esters and mixtures thereof. Particularly preferred bleach activators in the pH range from about 8 to about 9.5 are those selected from the group consisting of OBS and VL leavening group.

Preferred bleach activators are those described in U.S. Pat. No. 5,130,045, Mitchell et al, and copending patent applications U.S. Ser. Nos. 08/064,624, 08/064,623, 08/064,621, 08/064,562, 08/064,564, 08/082,270 and copending application to M. Burns, A. D. Willey, R. T. Hartshorn, C. K. Ghosh, entitled "Bleaching Compounds Comprising Peroxyacid Activators Used With Enzymes" and having U.S. Ser. No. 08/196,322 (P&G Case 4890R), all of which are incorporated herein by reference.

The mole ratio of peroxygen bleaching compound (AvO) to bleach activator in the present invention generally ranges from about 10:1 to about 1:1. Preferred ratios range from about 10:1 to about 3:1.

Chlorine bleach

An inorganic chlorine bleach ingredient such as chlorinated trisodium phosphate can be utilized, but organic chlorine bleaches such as the chlorocyanurates are preferred. Water-soluble dichlorocyanurates such as sodium or potassium dichloroisocyanurate dihydrate are particularly preferred.

Available chlorine or available oxygen of an ADD or a bleach component is the equivalent bleaching chlorine content thereof expressed as % equivalent $Cl_2$ by weight.

Silicone and Phosphate Ester Suds Suppressors

The ADDs of the invention can optionally contain an alkyl phosphate ester suds suppressor, a silicone suds suppressor, or combinations thereof. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADD for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of component (f).

Phosphate esters have also been asserted to provide some protection of silver and silver-plated utensil surfaces, however, the instant compositions can have excellent silvercare without a phosphate ester component. Without being limited by theory, it is believed that lower pH formulations, e.g., those having pH of 9.5 and below, plus the presence of the essential amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Detersive Enzymes (including enzyme adjuncts)

The compositions of this invention may optionally, but preferably, contain from 0 to about 8%, preferably from about 0.001% to about 5%, more preferably from about 0.003% to about 4%, most preferably from about 0.005% to about 3%, by weight, of active detersive enzyme. The knowledgeable formulator will appreciate that different enzymes should be selected depending on the pH range of the ADD composition. Thus, Savinase® may be preferred in the instant compositions when formulated to deliver wash pH of 10, whereas Alcalase® may be preferred when the ADDs deliver wash pH of, say, 8 to 9. Moreover, the formulator will generally select enzyme variants with enhanced bleach compatibility when formulating oxygen bleaches containing compositions of the present invention.

In general, the preferred detersive enzyme herein is selected from the group consisting of proteases, amylases, lipases and mixtures thereof. Most preferred are proteases or amylases or mixtures thereof.

The proteolytic enzyme can be of animal, vegetable or microorganism (preferred) origin. More preferred is serine proteolytic enzyme of bacterial origin. Purified or nonpurified forms of enzyme may be used. Proteolytic enzymes produced by chemically or genetically modified routants are included by definition, as are close structural enzyme variants. Particularly preferred by way of proteolytic enzyme is bacterial serine proteolytic enzyme obtained from Bacillus, *Bacillus subtilis* and/or *Bacillus licheniformis*. Suitable commercial proteolytic enzymes include Alcalase®, Esperase®, Durazym®, Savinase®, Maxatase®, Maxacal®, and Maxapem® 15 (protein engineered Maxacal); Purafect® and subtilisin BPN and BPN' are also commercially available. Preferred proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Most preferred is what is called herein "Protease C", which is a triple variant of an alkaline serine protease from Bacillus in which tyrosine replaced threonine at position 104, serine replaced asparagine at position 123, and alanine replaced threonine at position 274. Protease C is described in EP 90915958:4, corresponding to WO 91/06637, Published May 16, 1991, which is incorporated herein by reference. Genetically modified variants, particularly of Protease C, are also included herein. Some preferred proteolytic enzymes are selected from the group consisting of Savinase®, Esperase®, Maxacal®, Purafect®, BPN, Protease A and Protease B, and mixtures thereof. Bacterial serine protease enzymes obtained from *Bacillus subtilis* and/or *Bacillus licheniformis* are preferred. An especially preferred protease herein referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76 in combination with one or more amino acid residue position equivalent to those selected from the group consisting of +99, +101, +103, +107 and +123 in *Bacillus amyloliquefaciens* subtilisin as described in the concurrently filed patent application of A. Baeck, C. K. Ghosh, P. P. Greycar, R. R. Bott and L. J. Wilson, entitled "Protease-Containing Cleaning Compositions" and having U.S. Ser. No. 08/136,797 (P&G Case 5040). This application is incorporated herein by reference.

Suitable lipases for use herein include those of bacterial, animal, and fungal origin, including those from chemically or genetically modified mutants. Suitable bacterial lipases include those produced by Pseudomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced from the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with the Amano-P antibody, using the standard and well-known immunodiffusion procedure according to Oucheterlon (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. lipolyticum FERM P 1338 (available under the trade name Amano-CES), lipases ex *Chromobacter viscosum* var. lipolyticum NRRlb 3673, and further *Chromobatter viscosum* lipases, and lipases ex *Pseudomonas gladioli*. A preferred lipase is derived from *Pseudomonas pseudoalcaligenes*, which is described in Granted European Patent, EP-B-0218272. Other lipases of interest are Amano AKG and Bacillis Sp lipase (e.g. Solvay enzymes). Additional lipases which are of interest where they are compatible with the composition are those described in EP A 0 339 681, published Nov. 28, 1990, EP A 0 385 401, published Sep. 5, 1990, EO A 0 218 272, published Apr. 15, 1987, and PCT/DK 88/00177, published May 18, 1989, all incorporated herein by reference.

Suitable fungal lipases include those produced by *Humicola lanuginosa* and *Thermomyces lanuginosus*. Most preferred is lipase obtained by cloning the gene from *Humicola lanuginosa* and expressing the gene in *Aspergillus oryzae* as described in European Patent Application 0 258 068, incorporated herein by reference, commercially available under the trade name LipolaseR from Novo-Nordisk.

Any amylase suitable for use in a dishwashing detergent composition can be used in these compositions. Amylases include for example, a-amylases obtained from a special strain of *B. licheniforms*, described in more detail in British Patent Specification No. 1,296,839. Amylolytic enzymes include, for example, Rapidase™, Maxamyl™, Termamyl™ and BAN™. In a preferred embodiment, from about 0.001% to about 5%, preferably 0.005% to about 3%, by weight of active amylase can be used. Preferably from about 0.005% to about 3% by weight of active protease can be used. Preferably the amylase is Maxamyl™ and/or Termamyl™ and the protease is Savinase® and/or protease B. As in the case of proteases, the formulator will use ordinary skill in selecting amylases or lipases which exhibit good activity within the pH range of the ADD composition.

Enzyme Stabilizing System

Preferred enzyme-containing compositions, especially compositions containing peroxygen bleaching agents, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator win exercise a chemist's normal skill in avoiding the use of any scavenger which is majorly incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in the solid-form ADD composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al incorporated herein by reference.

Dispersant Polymer

Preferred compositions herein may additionally contain a dispersant polymer. When present, a dispersant polymer in the instant ADD compositions is typically in the range from 0 to about 25%, preferably from about 0.5% to about 20%, more preferably from about 1% to about 7% by weight of the ADD composition. Dispersant polymers are useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 1000 to about 250,000, and most preferably, especially if the ADD is for use in North American automatic dishwashing appliances, is from about 1000 to about 5,000.

Other suitable dispersant polymers include those disclosed in U.S. Pat. No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumadc acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[(C($R^2$)C($R^1$)(C(O)O$R^3$)]— wherein the incomplete valencies inside the square braces are hydrogen and at least one of the substituents $R^1$, $R^2$ or $R^3$, preferably $R^1$ or $R^2$, is a 1 to 4 carbon alkyl or hydroxyalkyl group, $R^1$ or $R^2$ can be a hydrogen and $R^3$ can be a hydrogen or alkali metal salt. Most preferred is a substituted acrylic monomer wherein $R^1$ is methyl, $R^2$ is hydrogen and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of 3500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Agglomerated forms of the present invention may employ aqueous solutions of polymer dispersants as liquid binders for making the agglomerate (particularly when the composition consists of a mixture of sodium titrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982, incorporated herein by reference.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula $HO(CH_2CH_2O)_m(CH_2CH(CH_3)O)_n(CH(CH_3)CH_2O)OH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred cellulose-derived dispersant polymers are the carboxymethyl celluloses.

Yet another group of acceptable dispersants are the organic dispersant polymers, such as polyaspartate.

Other Optional Adjuncts

Depending on whether a greater or lesser degree of compactness is required, filler materials can also be present in the instant ADDs. These include sucrose, sucrose esters, sodium chloride, sodium sulfate, potassium chloride, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates in magnesium-salt form. Note that preferences, in terms of purity sufficient to avoid decomposing bleach, applies also to component (b) ingredients.

Hydrotrope materials such as sodium benzene sulfonate, sodium toluene sulfonate, sodium cumene sulfonate, etc., can be present in minor amounts.

Short-chain amine oxides, such as octyldimethylamine oxide, decyldimethylamine oxide, dodecylamine oxide and tetradecylamine oxide or non-amine oxide aids such as solid-form alcohols or alcohol ethoxylates may be added as solubilizing aids to the long-chain amine oxide. This is especially preferred if the composition is for use in cold-fill automatic dishwashing appliances. When present, a short-chain amine oxide solubilizer is preferably at not more than 1/10 of the total mass of the cleaning amine oxide component. Thus, levels of short-chain amine oxide are typically in the range from about 0 to about 2.0%, preferably about 0.1% to about 1% of the ADD composition. Moreover, it has been discovered that a short-chain amine oxide, if used, is preferably uniformly dispersed within the long-chain amine oxide rather than being added to the ADD in a separate particle.

Bleach-stable perfumes (stable as to odor); and bleach-stable dyes (such as those disclosed in U.S. Pat. No. 4,714,562, Roselle et al, issued Dec. 22, 1987); can also be added to the present compositions in appropriate amounts. Other common detergent ingredients are not excluded.

Since certain granular ADD compositions herein can contain water-sensitive ingredients, e.g., in embodiments comprising anhydrous amine oxides or anhydrous citric acid, it is desirable to keep the free moisture content of the granular ADDs at a minimum, e.g., 7% or less, preferably 4% or less of the ADD; and to provide packaging which is substantially impermeable to water and carbon dioxide. Plastic bottles, including refillable or recyclable types, as well as conventional barrier cartons or boxes are generally suitable. When ingredients are not highly compatible, e.g., mixtures of silicates and citric acid, it may further be desirable to coat at least one such ingredient with a low-foaming nonionic surfactant for protection. There are numerous waxy materials which can readily be used to form suitable coated particles of any such otherwise incompatible components.

Method for Cleaning

The present invention also encompasses a method for cleaning soiled tableware comprising contacting said tableware with an aqueous medium having a pH range in a wash solution of from about 8 to about 13, more preferably from about 9 to about 12, and comprising a $SiO_2$ weight ratio of from about 10:1 to about 1:10 of monomeric silicate to second silicate component, nonionic surfactant and detergency builder, said aqueous medium being formed by dissolving automatic dishwashing detergent containing in an automatic dishwashing machine. A particularly preferred method also includes peroxygen bleach.

The following examples illustrate the compositions of the present invention and are not intended to limit the invention. All parts, percentages and ratios used herein are expressed as percent weight unless otherwise specified.

EXAMPLE I

Granular automatic dishwashing detergents of the present invention are as follows:

TABLE 1

| Ingredients | A | B |
|---|---|---|
| | % by weight of active material | |
| Sodium Citrate | 26.80 | 21.50 |
| Acusol 480N[1] | 6.00 | 6.00 |
| Sodium carbonate | 4.00 | 3.80 |
| Britesil $H_2O$ (as $SiO_2$) | 6.00 | 6.00 |
| Metasilicate (as $SiO_2$) | 8.50 | 8.50 |
| Nonionic surfactant[2] | 3.00 | 3.00 |
| Termamyl 60T | 1.50 | 1.50 |
| Alcalase 2T | 3.60 | 3.60 |
| Percarbonate (Interox) (as AvO) | 1.50 | 1.50 |
| Benzoyloxybenzenesulphonate | 3.80 | — |
| Nonaroxybenzenesulphonate | — | 3.80 |
| Diethylene triamine penta methyl phosphonic acid | 0.13 | 0.13 |
| Sulfate, water, etc. | balance | |

[1]From Rohm and Haas
[2]Low cloud point, high hydrophilic-lyphophilic balance

TABLE 2

| Ingredients | C | D |
|---|---|---|
| | % by weight of active material | |
| Citrate | 29.00 | 29.00 |
| Acusol 480N[1] | 6.00 | 6.00 |
| Sodium carbonate | 5.00 | 5.00 |
| Britesil $H_2O$ (as $SiO_2$) | 7.00 | 7.00 |
| Sodium Metasilicate (as $SiO_2$) | 9.80 | 9.80 |
| HEDP | 0.50 | 0.50 |
| Nonionic surfactant[2] | 1.50 | 1.50 |

TABLE 2-continued

| Ingredients | C | D |
|---|---|---|
| | % by weight of active material | |
| Savinase 12T | 2.00 | 2.20 |
| Termamyl 60T | 1.50 | 1.50 |
| Perborate monohydrate (as AvO) | 1.20 | 1.20 |
| Diethylene triamine penta methyl phosphonic acid | 0.13 | 0.13 |
| Paraffin | 0.50 | 0.50 |
| Benzotriazole | 0.30 | 0.30 |
| Sulfate, water, etc. | balance | |

[1]Dispersant from Rohm and Haas
[2]Low cloud, high HLB nonionic surfactant

EXAMPLE II

Granular automatic dishwashing detergents of the present invention containing chlorine bleach are as follows:

TABLE 3

| Ingredients | E | F | G |
|---|---|---|---|
| | % by weight of active material | | |
| Metasilicate (as $SiO_2$) | 9.00 | 9.00 | 9.00 |
| Sodium polyacrylate | — | 8.90 | — |
| Sodium carbonate | 10.00 | 10.00 | 10.00 |
| Sodium tripolyphosphate | 25.00 | — | 25.00 |
| 20r Britesil (as $SiO_2$) | 3.00 | 3.00 | 3.00 |
| Nonionic surfactant | 2.50 | 2.58 | 2.58 |
| Sodium dichlorocyanurate | 2.50 | 2.50 | 2.50 |
| Water, minors | | balance | |

What is claimed is:

1. An automatic dishwashing detergent composition comprising, by weight:

(a) from about 1% to about 10% of $SiO_2$ as monomeric silicate;

(b) from about 1% to about 10% of $SiO_2$ as a second silicate component having a $SiO_2$:$M_2O$ weight ratio (where M=alkali metal) of from about 2 to about 2.4, wherein said monomeric silicate (a) and silicate component (b) have a $SiO_2$ weight ratio of from about 10:1 to about 1:10; and wherein the automatic dishwashing detergent composition comprises from about 5% to about 12% total $SiO_2$;

(c) from about 0.01% to about 15% of low foaming surfactant, (d) from about 0.1% to about 50% of a detergency builder; wherein said detergency builder is a salt or salt/builder of sodium/potassium phosphate; and (e) from about 0.001% to about 5% of a detersive enzyme; wherein said composition has a pH of from about 9.5 to about 10.5.

2. A composition according to claim 1 further comprising a bleaching agent selected from the group consisting of peroxygen bleaches and chlorine bleaches.

3. A composition according to claim 2 wherein said bleaching agent is selected from the group consisting of percarbonate salts and perborate salts.

4. A liquid composition according to claim 3 further comprising from about 0.01% to about 6% by weight of an enzyme stabilizing system.

5. A composition according to claim 4 wherein said detersive enzyme is selected from the group consisting of protease, amylase, lipase and mixtures thereof.

6. A composition according to claim 5 comprising from about 0.005 to about 3% by weight protease or amylase.

7. A composition according to claim 1 comprising from about 1% to about 10% of $SiO_2$ as metasilicate and from about 3% to about 6% of said $SiO_2$ as said second silicate component.

8. A composition according to claim 7 wherein the weight ratio of metasilicate (a) to second silicate component (b) is between about 3:1 and about 1:2.

9. A composition according to claim 2 comprising from about 0.01% to about 8% available oxygen.

10. A composition according to claim 1 further comprising from about 0.1% to about 8% of an anionic co-surfactant.

11. A composition according to claim 2 wherein said low foaming surfactant is selected from the group consisting of alkoxylated alcohols.

12. A composition according to claim 3 further comprising from about 0.5% to about 20% of a dispersant polymer.

13. A composition according to claim 12 wherein said dispersant polymer is selected from the group consisting of polacrylates and polyacrylate copolymers.

14. A method for cleaning soiled tableware comprising contacting said tableware with an aqueous detergent composition comprising (a) from about 1% to about 10% $SiO_2$ as monomeric silicate, (b) from about 1% to about 10% $SiO_2$ as a second silicate component having a $SiO_2$:$M_2O$ weight ratio (where M=alkali metal) from about 2 to about 2.4, and wherein said monomeric silicate (a) and second silicate component (b) have a $SiO_2$ weight ratio of from about 3:1 to about 1:2, and wherein the aqueous wash medium comprises from about 5% to about 12% total $SiO_2$; c) nonionic surfactant, d) from about 0.001% to about 5% of a detersive enzyme, and e) detergency builder; wherein said detergency builder is sodium/potassium phosphate; wherein said composition has a pH of from about 9.5 to about 10.5.

* * * * *